United States Patent [19]

Ranz

[11] 4,329,118

[45] May 11, 1982

[54] CENTRIFUGAL BLOWER WHEELS

[75] Inventor: James R. Ranz, Wilmington, Ohio

[73] Assignee: Philips Industries, Inc., Dayton, Ohio

[21] Appl. No.: 110,412

[22] Filed: Jan. 8, 1980

[51] Int. Cl.[3] ..... F04D 29/26

[52] U.S. Cl. ..... 416/178; 416/187; 29/156.8 CF

[58] Field of Search ..... 410/178, 184, 187, 199; 415/DIG. 3, 87; 29/156.8 CF

[56] References Cited

U.S. PATENT DOCUMENTS

| | | | |
|---|---|---|---|
| 1,069,854 | 8/1913 | Chisholm et al. | 416/220 A |
| 2,724,547 | 11/1955 | Abbott et al. | 416/184 |
| 3,165,258 | 1/1965 | Wentling et al. | 416/178 |
| 3,385,511 | 5/1968 | Wentling | 416/178 |
| 3,543,368 | 12/1970 | Marlow | 415/DIG. 3 |
| 3,567,335 | 3/1971 | David et al. | 416/134 |

*Primary Examiner*—Leonard E. Smith

*Attorney, Agent, or Firm*—Biebel, French & Nauman

[57] ABSTRACT

A line of forwardly curved blower wheels of different diameters incorporates blades of the same angular extent in all wheels but with the radii of curvature of the individual blades proportional to the diameter of the wheel wherein they are incorporated. In addition, the center disks of the double inlet wheels and the end plates of the single inlet wheels are provided with novel mounting structure comprising segments bent out of the plane of the disk or end plate and secured to opposite ends of the hub member by which the wheel is mounted on a shaft, and the individual blades are retained in complementary slots in the disk or plate and fillet welded to the disk or plate respectively.

15 Claims, 8 Drawing Figures

CENTRIFUGAL BLOWER WHEELS

BACKGROUND OF THE INVENTION

This invention relates to improvements in the manufacture and construction of centrifugal blower wheels, and it is especially concerned with blower wheels of the forwardly curved type, i.e. wherein the individual blades have their concave sides facing in the direction of rotation of the wheel. The prior art with which applicant is most familiar comprises United States patents issued to his assignee over the past 30 years, particularly Wilken U.S. Pat. Nos. 2,537,805, 2,628,419, 2,628,659 and 2,852,182, Wentling U.S. Pat. Nos. 3,165,258, 3,211,364 and 3,385,511, and Ranz U.S. Pat. No. 3,737,966, and the blower wheels manufactured and sold thereunder.

In that past commercial practice, while some wheels have been manufactured with the end rings resistance welded to the blades, the end rings were of one or another special configuration to provide small areas of contact with the blades during welding, and the more common practice has been to employ end rings which were spun into overlapping relation with flanges formed radially outwardly from the ends of the blades. This practice is wasteful of the sheet metal scrap which is produced from the areas between the flanges of adjacent blades as they are blanked out of sheet stock, and it also has a high initial tooling cost for the dies which blank and form the flange portions of the blades.

These facts have resulted in a common practice of producing blades of the same angular dimensions for all sizes of wheels of a given type, in order to minimize the tooling cost, and also to limit the angular extent of the individual blades to substantially less than 90°, since the wider the blade, the greater amount of scrap around its flange portions. This in turn made it necessary to increase the number of blades for each successively larger diameter wheel, with the result that wheels made by that conventional practice by applicant's assignee have incorporated as many as 56 blades for a 25-inch diameter wheel and 66 blades for a 30-inch wheel.

SUMMARY OF THE INVENTION

The present invention provides a variety of novel features and advantages in the construction and manufacture of centrifugal blower wheels over the prior art practice as summarized above, and more particularly, it provides forwardly curved blower wheels characterized by the incorporation of all of the features summarized below:

(a) The individual blades are square ended, for welding to the end rings and end plates which complete the wheel, thereby eliminating the scrap which would be produced around formed end portions as well as the need for special dies to blank and form such end portions.

(b) The individual blades are of substantially greater angular extent than the blades used in the prior art wheels produced by applicant's assignee, e.g. 100° as compared with 95°, so that the same surface area is provided by a correspondingly smaller number of blades.

(c) The radius of curvature of the blades is increased in substantially direct proportion with the diameter of the finished wheel so that the same number and angular spacing of the blades can be used successfully over a wide range of blade diameters, e.g. 37 blades for the full range of diameters from 20 inches to 36 inches.

(d) The center disks of double inlet wheels and plates of single inlet wheels are provided with arcuate slots for receiving the blades therethrough in accurately predetermined angular positioning, and the blades are fillet welded to the center disk or center plate, as the case may be, for increased rigidity in the finished wheel.

The invention also provides an improved and simplified mounting structure for its blower wheels, wherein the annular disk which is the main component of either a center disk or an end plate has its inner portion divided radially into a plurality of segments, and alternate segments are bent in the same direction out of the plane of the disk to provide space between the planes defined by their radially inner ends and the radially inner ends of the other segments. In a center disk, adjacent segments are bent in opposite directions, while in an end plate, one set of alternate segments remains in the plane of the rest of the disk, and in either case, a spool or other hub member is positioned in the space between the radially inner ends of adjacent segments and welded thereto to complete the mounting structure.

Other objects and advantages of the invention will be apparent from the detailed description of preferred embodiments which follows.

DESCRIPTION OF PREFERRED EMBODIMENTS

Figure 1:
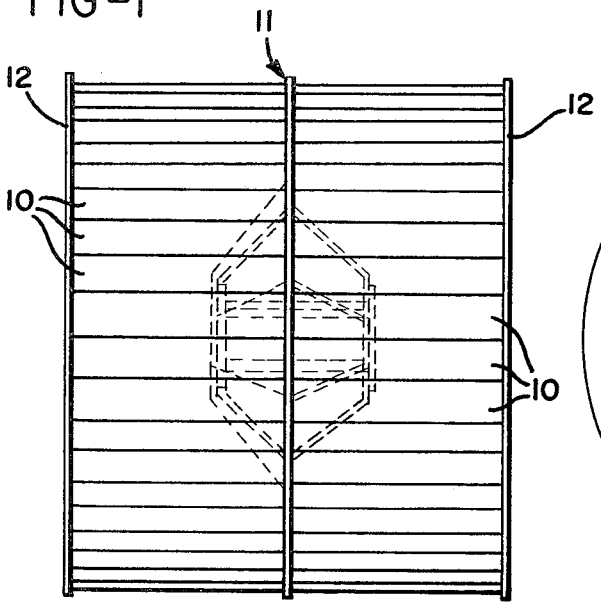
FIG. 1 is a view in side elevation of a double inlet blower wheel constructed in accordance with the invention.
Figure 2:
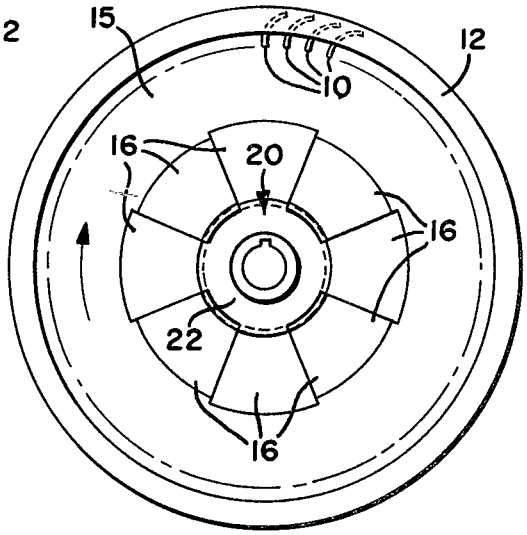
FIG. 2 is an end view of the blower wheel of FIG. 1.
Figure 3:
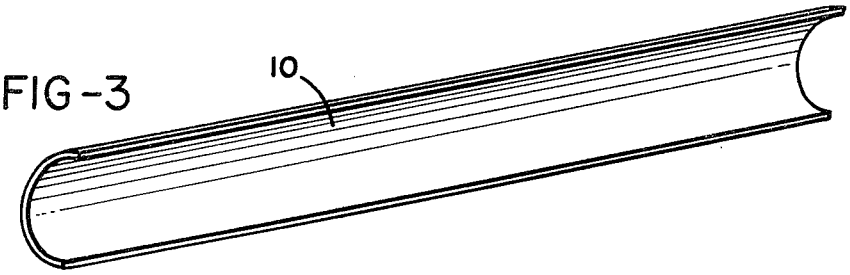
FIG. 3 is a view in perspective of a typical blade for a blower wheel in accordance with the invention.

The blower wheel shown in FIGS. 1–6 comprises a plurality of blower blades 10, a center disk assembly 11 and a pair of end rings 12. The individual blades 10 are blanked from sheet metal with square ends as shown in FIG. 3, and are curved about a radius the length of which is substantially proportional to the diameter of the finished wheel, as explained in more detail hereinafter. The end rings 12 are similarly blanked from sheet metal to a width which varies with the diameter of the wheel, and they are fillet welded to the square ends of the blades 10.

As noted in the foregoing Summary, one of the features of the invention is that the blades 10 are of substantially greater angular extent than in the common practice of the prior art, preferred results having been obtained with each blade subtending an angle of 100°, and another feature is that the radius of curvature of the blades is increased in substantially direct proportion with the diameter of the finished wheel. On this point, preferred results have been obtained with a ratio of blade radius to wheel diameter of substantially 1:17, and practical examples are a blade radius of 1.18 inches for a 20-inch wheel, a blade radius of 1.47 inches for a 25-inch wheel, a blade radius of 1.78 inches for a 30-inch wheel, and a blade radius of 2.12 inches for a 36-inch wheel.

Also as noted in the foregoing Summary, it has been found possible and desirable in the practice of the invention with blades of the above axial extent and radii of curvature to utilize the same number of blades in wheels of all diameter, and specifically 37 blades over the full range of wheel diameters from 20 to 36 inches. This provides a substantial saving in parts and material over the prior practice of applicant's assignee, which has employed 56 blades in a 25-inch diameter wheel and 66 blades in a 30-inch wheel, with all of the blades being of the same angular extent. The number "37" is not critical, but was selected as the only prime number in the preferred range of 35–40.

Figure 4:
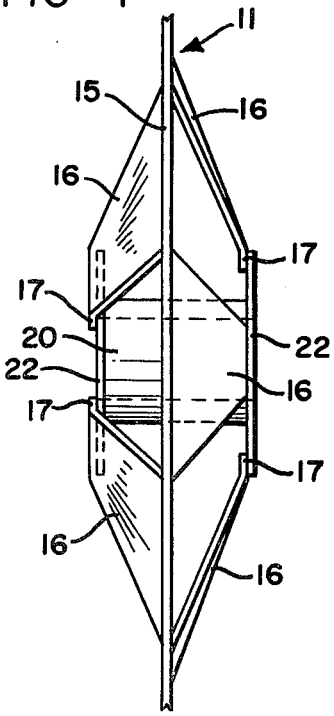
FIG. 4 is a fragmentary side view of the hub structure used in the wheel of FIGS. 1 and 2, and on a larger scale.
Figure 5:
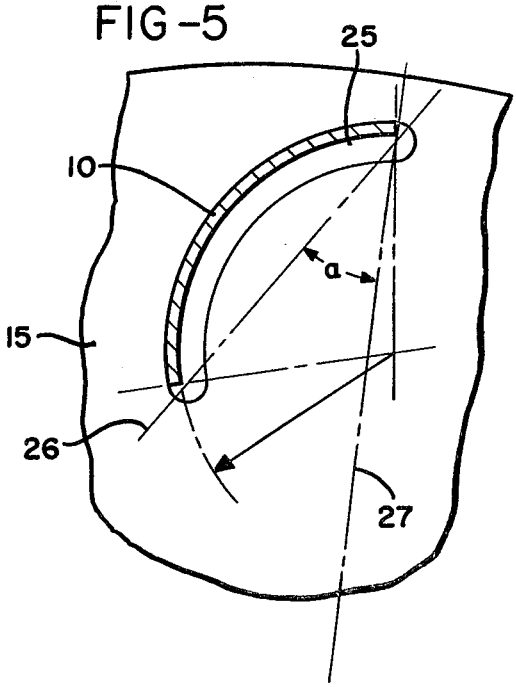
FIG. 5 is a fragmentary view on a larger scale showing one of the blade-receiving slots in the center disk of the wheel of FIGS. 1 and 2, and the relation of the slot to the axis of the wheel.
Figure 6:
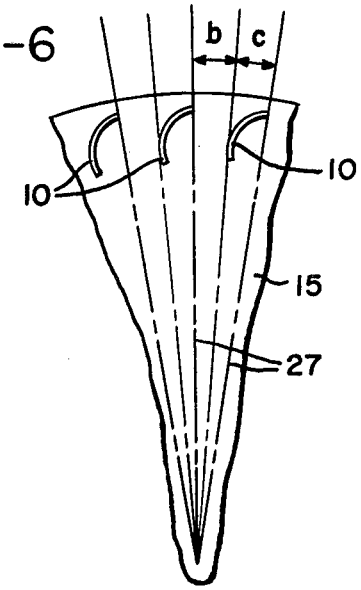
FIG. 6 is a fragmentary view showing the angular positioning of adjacent blades in the center disk of the wheel of FIGS. 1 and 2.

Referring particularly to FIGS. 4–6, the center disk assembly 11 serves as a positioning and supporting member for the blower sheet and incorporates the huh structure by which the wheel is mounted on a shaft. The main component is an annular disk 15 of sheet metal and of approximately the same diameter as the associated end rings 12. Its inner portion is separated radially into eight segments 16 of equal angular extent, and alternate ones of these segments are bent in opposite directions out of the plane of the disk through an angle of preferably less than 45°, e.g. 25°–40°. The inner end portions of each of these segments is bent in the reverse direction to form flanges 17 substantially parallel with the body of the disk 15.

The result of this formation of the segments 16 is that a space is defined between the flanges 17 which receives a hub member comprising a spool 20 having flanges 22 at each end which are proportioned to butt the flanges 17 and are welded thereto. These parts are readily assembled by manipulating one end of the spool 20 into the space between the flanges 17 so that the flanges 22 can be welded to the inside surfaces of one set of flanges 17 and the outside surfaces of the other set of flanges 17 with the bent segments on each side of the plane of the disk corporating in a bracing relationship with each other and the spool 20.

The disk 15 is also provided with a plurality of arcuate slots 25 near its outer periphery which are proportioned to receive the plurality of blades 10 in accurately angularly positioned relation both with each other and with the axis of the wheel. Referring particularly to FIG. 5, each slot 25 is of just sufficiently greater angular extent than the associated blade 10 to receive the blade readily therethrough, and the radially outermost portion of the slot is spaced inwardly of the periphery of the disk to leave a significant web of metal outwardly of the slot, e.g. of a minimum width of 0.25 inch.

Tooling considerations require that the slot 25 be substantially wider than the blade thickness, in that the punch used to form the slots must be thick enough for adequate strength. This consideration has been satisfied in the practice of the invention with each slot having a radial width of approximately 0.230 inch and with the outer radius of the slot sized to provide the slot with an outer edge which will substantially match the outer surface of a blade 10 of the maximum thickness tolerance of the selected gauge of sheet metal, e.g. approximately 2.18 for blades of 16-gauge sheet steel, namely with an average thickness of approximately 0.060 inch. For example, for a 36-inch diameter wheel, satisfactory results have been obtained with an outer radius of approximately 2.180 inches for each slot 25.

The angular relation of each slot 25, and therefore of the blade 10 therein, to the axis of the wheel is important to the purposes of the invention. As illustrated in FIG. 5, each slot is so located that a line 26 connecting the edges of the blade 10 therein will define an angle a with a radius 27 to the outer edge of the blade, and preferred results have been obtained with this angle a equal to 32°. As shown in FIG. 6, this arrangement, with 37 blades in the wheel as described above, provides a space between adjacent blades which spans an angle b greater than the angle c spanned by the blade itself, the angle b and c together equaling 360° divided by the total number of blades in the finished wheel.

In assembling the wheel shown in FIGS. 1 and 2, the complete center disk sub-assembly and the rings are assembled in a suitable fixture with the proper number of blades inserted through the slots 25, and means are provided in the fixture for pressing each blade against the outer edge of its slot 25. Assembly of the wheel is then completed by fillet welding both ends of each blade to the respective end plates 12, and by fillet welding each blade to the disk 15 along the junction between the blade and the outer edge of its slot 25. The same procedure is followed for all sizes of wheels.

Figure 7:
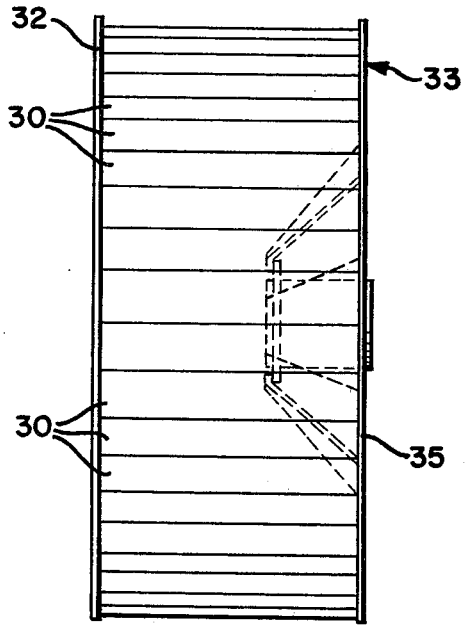
FIG. 7 is a view in side elevation of a single inlet blower wheel constructed in accordance with the invention.
Figure 8:
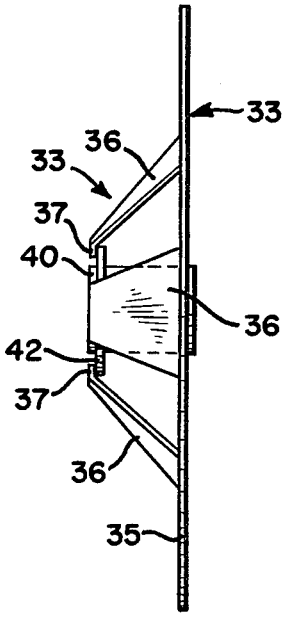
FIG. 8 is a view similar to FIG. 3 showing the hub structure of the end plate in the wheel of FIG. 7.

FIGS. 7 and 8 illustrate a single inlet blower wheel constructed in accordance with the invention and comprising multiple blades 30, an end ring 32 and an end plate assembly 33. The individual blades 30 are of the same configuration and formed to the same dimensions described in connection with FIG. 3, and the end ring 32 is a duplicate of the end rings 12 for wheels of the same diameter and is fillet welded to the square ends of the blades 30.

The end plate assembly 33 has the same function as the center disk assembly 11 in positioning and supporting the blades and incorporating the hub structure by which the finished wheel is mounted on a shaft. Its main component is an annular disk 35 of the same diameter as the associated end ring 32, and the inner end portions of the bent segments are bent back to form flanges 37 substantially parallel with the unbent segments.

The two sets of segments 36 thus define a space therebetween for receiving the hub member 40, which is shown as a cylindrical body provided with a peripheral flange 42 at one end which seats on the inner faces of the flanges 37 and is welded thereto. The other end of the hub 40 fits between the inner portions of the unbent segments 36 and is welded thereto. It is apparent that a spool type hub such as is shown in FIGS. 1 and 2 could also be used equally effectively in the end plate assembly 33.

The disk 35 is provided with an array of slots 44 of the same individual configurations and the same locations and angular relations as the slots 25 in the center disk 15 of the double inlet sheel. With this construction, the end plate assembly will serve in the same manner as the center disk assembly 15 for receiving and holding the ends of the blades 30 in a suitable welding fixture while the individual blades are fillet welded to the end rings 32 and to the disk 35, the welds being located along the junctions between the blades 30 and the outer edges of the slots 44, and the ends of the blades projecting beyond the slots only sufficiently for adequate retention until they are welded, e.g. inch.

While the articles herein described constitute preferred embodiments of the invention, it is to be understood that the invention is not limited to these precise articles, and that changes may be made therein without departing from the scope of the invention.

What is claimed is:

1. A centrifugal blower wheel comprising multiple blower blades, and supporting means for said blades including an annular disk having a centrally located opening therethrough, the inner portion of said disk being divided radially into a plurality of segments, alternate said segments being bent in the same direction out of the plane of said disk through an angle of less than 45° into axially overlying relation with the other said segments to provide space between the planes defined by the radially inner ends thereof and the radially inner ends of said other segments, rigid hub means mounted in said space, and means securing said hub means to the radially inner ends of all of said segments with said bent segments in bracing relation with each other and the end of said hub means secured thereto.

2. A blower wheel as defined in claim 1 wherein said hub means comprises a spool member smaller in diameter than said opening, and flange means secured to the ends of said spool member and to said radially inner ends of said segments.

3. A blower wheel as defined in claim 1 wherein said angle is not greater than 45°, and wherein said radially inner ends of said bent segments are bent in the opposite direction into substantially parallel relation with the plane of said disk.

4. A double inlet blower wheel as defined in claim 1 wherein said disk is located intermediate the ends of said wheel, and wherein adjacent said segments are bent in opposite directions out of the plane of said disk.

5. A single inlet blower wheel as defined in claim 1 wherein said disk is located at one end of said wheel, and wherein said other segments are maintained in the plane of said disk.

6. A blower wheel as defined in claim 1 wherein said disk is provided adjacent the periphery thereof with slots each proportioned to receive one of said blades therethrough, and means forming a welded connection between each said blade and said disk.

7. A double inlet blower wheel as defined in claim 6 wherein said disk is located intermediate the ends of said wheels, wherein adjacent said segments are bent in opposite directions out of the plane of said disk, and further comprising end rings welded to the ends of said blades.

8. A forwardly curved centrifugal blower wheel comprising multiple blower blades each curved about the same radius, supporting means for said blades including an annular disk provided with hub means for mounting on a shaft, said disk having multiple slots adjacent the periphery thereof and receiving said blades therethrough, fillet welds securing said blades to said disk adjacent said slots, and end ring means welded to the ends of said blades remote from said disk.

9. A blower wheel as defined in claim 8 wherein the number, curvature and angular spacing and positioning of said blades is such that there is a space between each pair of adjacent blades at least equal in angular extent to the angular space occupied by each said blade.

10. A double inlet blower wheel as defined in claim 8 wherein said disk is located intermediate the ends of said wheel, and one of said end ring means is provided at each end of said wheel.

11. A single inlet blower wheel as defined in claim 8 wherein said disk is located at one end of said wheel.

12. A blower wheel as defined in claim 8 wherein the ratio of the radius of curvature of said blades to the diameter of said wheel is approximately 1:17.

13. A blower wheel as defined in claim 8 wherein each said blade is substantially 100° in angular extent.

14. A line of forwardly curved blower wheels of different diameters, each said wheel comprising multiple blower blades of arcuate curvature and the same angular dimension, supporting means for said blower blades including at least one end ring and a supporting disk provided with hub means for mounting on a shaft, all of said wheels having the same number of blades, the ratio of the diameter of each said wheel to the radius of curvature of the blades therein being substantially the same for all of said different diameter wheels, and the number, curvature and angular spacing and position of said blades being such that there is a space between each pair of adjacent blades at least equal in angular extent to the angular space occupied by each said blade.

15. A line of forwardly curved blower wheels of different diameters, each said wheel comprising multiple blower blades of arcuate curvature and the same angular dimension, supporting means for said blower blades including at least one end ring and a supporting disk provided with hub means for mounting on a shaft, all of said wheels having the same number of blades, the ratio of the diameter of each said wheel to the radius of curvature of the blades therein being substantially the same for all of said different diameter wheels, each said blade being substantially 100° in angular extent and the ratio of the radius of curvature of each said blades to the diameter of the wheel of which it is a component being substantially 1:17.

* * * * *